US009061823B2

(12) United States Patent
Sugimoto et al.

(10) Patent No.: US 9,061,823 B2
(45) Date of Patent: Jun. 23, 2015

(54) TWO-FLUID DISPENSER

(75) Inventors: Hiroki Sugimoto, Nagakute (JP); Mitsuo Furusawa, Tokyo (JP)

(73) Assignees: HOYU CO., LTD., Aichi (JP); YOSHINO KOGYOSHO CO., LTD., Tokyo (JP)

( * ) Notice: Subject to any disclaimer, the term of this patent is extended or adjusted under 35 U.S.C. 154(b) by 170 days.

(21) Appl. No.: 13/820,059

(22) PCT Filed: Aug. 26, 2011

(86) PCT No.: PCT/JP2011/004770

§ 371 (c)(1),
(2), (4) Date: Mar. 18, 2013

(87) PCT Pub. No.: WO2012/029272

PCT Pub. Date: Mar. 8, 2012

(65) Prior Publication Data

US 2013/0175297 A1 Jul. 11, 2013

(30) Foreign Application Priority Data

Aug. 31, 2010 (JP) ..... 2010-193738

(51) Int. Cl.
*B67D 7/70* (2010.01)
*B65D 83/68* (2006.01)
(Continued)

(52) U.S. Cl.
CPC ..... *B65D 83/68* (2013.01); *B65D 83/206* (2013.01); *B65D 83/682* (2013.01); *B65D 81/3205* (2013.01); *B65D 83/40* (2013.01)

(58) Field of Classification Search
CPC .... B65D 83/40; B65D 83/68; B65D 81/3205; B65D 83/682
USPC ..... 222/135–137, 145.3, 145.5, 145.7, 222/145.8, 492.13
See application file for complete search history.

(56) References Cited

U.S. PATENT DOCUMENTS 5,941,420 A * 8/1999 Connan ..... 222/94
6,454,130 B1 * 9/2002 Miller et al. ..... 222/94
7,617,950 B2 * 11/2009 Norris et al. ..... 222/145.3

FOREIGN PATENT DOCUMENTS

JP A-11-334767 12/1999
JP A-2000-109150 4/2000
(Continued)

OTHER PUBLICATIONS

International Search Report issued in International Patent Application No. PCT/JP2011/004770 mailed Nov. 29, 2011.
Office Action issued in British Patent Application No. GB 1303561.3 dated Dec. 10, 2013.
(Continued)

*Primary Examiner* — Lien Ngo
(74) *Attorney, Agent, or Firm* — Oliff PLC

(57) ABSTRACT

A two-fluid dispenser capable of reducing odor, even when one of two fluids dispensed in foam has pungent odor. The dispenser includes: a first and a second dispenser container each including an upper surface from which a stem protrudes and is configured to dispense a fluid therein in foam in response to the stem depressed; and a dispenser tool fixedly fitted over the containers. The dispenser tool includes a dispenser head communicating with the containers and including a nozzle, so that when the dispenser head is depressed, the fluids are dispensed from the containers through the nozzle. The dispenser head includes a fluid guide mechanism to guide the fluids from the containers to be dispensed in foam through the nozzle such that the fluids have a layered pattern in which a first fluid layer is at least partly covered by a second fluid layer.

6 Claims, 15 Drawing Sheets

(51) Int. Cl.

| | |
|---|---|
| ***B65D 83/20*** | (2006.01) |
| ***B65D 81/32*** | (2006.01) |
| ***B65D 83/40*** | (2006.01) |

(56) References Cited

FOREIGN PATENT DOCUMENTS

| | | |
|---|---|---|
| JP | A-2002-326678 | 11/2002 |
| JP | A-2002-326683 | 11/2002 |
| JP | A-2005-35631 | 2/2005 |
| JP | A-2007-99286 | 4/2007 |

OTHER PUBLICATIONS

Office Action issued in Chinese Application No. 201180048876.8 dated Mar. 11, 2014 (with partial translation).

Office Action issued in British Patent Application No. 1303561.3 dated Feb. 21, 2014.

Office Action issued in Korean Patent Application No. 10-2013-7006712 mailed Jan. 27, 2014 (with translation).

Jul. 1, 2014 Office Action issued in Japanese Application No. 2010-193738 (with translation).

Nov. 2, 2014 Office Action issued in Chinese Patent Application No. 2011800488768.

* cited by examiner

TWO-FLUID DISPENSER

TECHNICAL FIELD

The present invention relates to a two-fluid dispenser.

BACKGROUND ART

Various two-fluid dispensers have been proposed which include a juxtaposed pair of aerosol cans and a dispenser tool fitted over the aerosol cans and are configured to dispense fluids contained in the aerosol cans through the dispenser tool. (Refer to Patent Literature 1, for example.)

The two-fluid dispenser disclosed in Paten Literature 1 includes two aerosol cans and the dispenser tool connecting upper portions of the aerosol cans. The dispenser tool includes a nozzle communicated with a stem of each aerosol can, and the nozzle is provided in a horizontally middle portion thereof with a partition plate vertically extending to divide a space in the nozzle into left and right portions. By depressing a depression head of the dispenser tool using a lever, the stem of each aerosol can is pushed down, and fluids contained in the aerosol cans are dispensed through the nozzle.

In this regard, since the space in the nozzle is divided into the left and right portions by the partition plate, the fluids from the stems are further dispensed in a form of a foam through an end of the nozzle such that the fluids have a double-layered structure in which the fluids are layered on a left side and a right side.

CITATION LIST

Patent Literature

PTL 1: JP11334767A

SUMMARY OF THE INVENTION

Technical Problem

In dispensing a mixture of two fluids using a two-fluid dispenser as mentioned above, when a hair dye is used as the dispensed fluids, for example, one of the fluids can have a pungent odor such as an ammonia odor. In this case, maximum reduction of the pungent odor is required. There is room for improvement in reduction of the pungent odor in the case of the conventional two-fluid dispenser in which the fluids are juxtaposed on the left and the right side.

The present invention has been conceived in view of the above problem and aims to provide a two-fluid dispenser that is capable, even when one of the two fluids dispensed in the form of either a foam or a viscous fluid has a pungent odor, of sufficiently reducing the pungent odor.

Solution to Problem

A first aspect of the present invention resides in a two-fluid dispenser comprising: a pair of a first and a second dispenser container A1 and A2 each including an upper surface from which an upwardly urged and depressible stem 11 protrudes and is configured to dispense a fluid therein in a form of one of a foam and a viscous fluid in response to the stem 11 being depressed; and a dispenser tool B fixedly fitted over the first and the second dispenser container A1 and A2 for dispensing the two fluids from the first and the second dispenser container A1 and A2, the dispenser tool B including a dispenser head B3 communicating with the first and the second dispenser container A1 and A2 and including a nozzle 41, so that when the dispenser head B3 is depressed, the fluids are dispensed from the first and the second dispenser container A1 and A2 through the nozzle 41, wherein the dispenser head B3 is provided inside thereof with a fluid guide mechanism to guide the fluids from the first and the second dispenser container A1 and A2 to be dispensed through the nozzle 41 such that a cross-sectional pattern of the dispensed fluids has a layered structure in which at least an upper surface of a first fluid layer L1 is covered by a second fluid layer L2.

A second aspect of the present invention resides in the two-fluid dispenser of the first aspect, wherein the cross-sectional pattern of the dispensed fluids comprises the first fluid layer L1 and the second fluid layer L2 layered on the first fluid layer L1, the second fluid layer L2 having a same width as the first fluid layer L1.

A third aspect of the present invention resides in the two-fluid dispenser of the second aspect, wherein the dispenser head B3 further includes: a casing 40 having a front surface from which the nozzle 41 protrudes; and a first and a second stem fitting tube 42 and 43 suspending from the casing 40 such that the first stem fitting tube 42 is fitted to a first stem 11*a* and the second stem fitting tube 43 is fitted to a second stem 11*b*, and wherein the fluid guide mechanism is structured by dividing a space in the casing 40 into a first and a second fluid compartment 46 and 47 on a right and a left side, and by dividing a base end portion of the nozzle 41 into an upper base end portion and a lower base end portion to provide a first through-hole 49 for bringing the first fluid compartment 46 into communication with a lower portion of the nozzle 41 and a second through-hole 50 for bringing the second fluid compartment 47 into communication with an upper portion of the nozzle 41.

A fourth aspect of the present invention resides in the two-fluid dispenser of the second aspect, wherein the dispenser head B3 further includes: a casing 40 having a front surface from which the nozzle 41 protrudes; and a first and a second stem fitting tube 42 and 43 suspending from the casing 40 such that the first stem fitting tube 42 is fitted to a first stem 11*a* and the second stem fitting tube 43 is fitted to a second stem 11*b*, and wherein the fluid guide mechanism is structured by providing a partition wall 45*a* vertically extending in a front-to-rear direction in a middle portion of the casing 40 to divide a space in the casing 40 into a first and a second fluid compartment 46 and 47 on a right and a left side, the partition wall 45*a* including a cross-sectional structure having a lower vertical wall 52, a horizontal wall 53 extending from an upper end of the lower vertical wall 52, and an upper vertical wall 54 standing from another end of the horizontal wall 53, and by bringing a front end of a space below the horizontal wall 53 into communication with a lower base end portion of the nozzle 41 and bringing a front end of a space above the horizontal wall 53 into communication with an upper base end portion of the nozzle 41.

A fifth aspect of the present invention resides in the two-fluid dispenser of the second aspect, wherein the dispenser head B3 further includes: a casing 40 having a front surface from which the nozzle 41 protrudes; and a first and a second stem fitting tube 42 and 43 suspending from the casing 40 such that the first stem fitting tube 42 is fitted to a first stem 11*a* and the second stem fitting tube 43 is fitted to a second stem 11*b*, and wherein the fluid guide mechanism is structured by forming a lower first fluid feed chamber 55 and an upper second fluid feed chamber 56 in a front end of the casing 40 located at a rear of the nozzle 41, by dividing a space in the casing 40 except for the first and the second fluid feed chamber 55 and 56 into a first and a second fluid compartment 46 and 47 on a right and a left side, and by bringing the first fluid compartment 46 into communication with the first fluid feed chamber 55 and bringing the second fluid compartment 47 into communication with the second fluid feed chamber 56, with the first fluid feed chamber 55 being open at a front end thereof to a lower base end portion of the nozzle 41 and the second fluid feed chamber 56 being open at a front end thereof to an upper base end portion of the nozzle 41.

A sixth aspect of the present invention resides in the two-fluid dispenser of the first aspect, wherein the cross-sectional pattern of the dispensed fluids comprises the first fluid layer L1 and the second fluid layer L2 covering the upper, a right, and a left surface of the first fluid layer L1.

A seventh aspect of the present invention resides in the two-fluid dispenser of the sixth aspect, wherein the dispenser head B3 further includes: a casing 40 having a front surface from which the nozzle 41 protrudes; and a first and a second stem fitting tube 42 and 43 suspending from the casing 40 such that the first stem fitting tube 42 is fitted to a first stem 11*a* and the second stem fitting tube 43 is fitted to a second stem 11*b*, and wherein the fluid guide mechanism is structured by forming a lower first fluid feed chamber 55 and an upper second fluid feed chamber 56 in a front end of the casing 40 located at a rear of the nozzle 41, by dividing a space in the casing 40 except for the first and the second fluid feed chamber 55 and 56 into a first and a second fluid compartment 46 and 47 on a right and a left side, by bringing the first fluid compartment 46 into communication with the first fluid feed chamber 55 and bringing the second fluid compartment 47 into communication with the second fluid feed chamber 56, and by providing, at a front end of the first fluid feed chamber 55, a first through-hole 49 communicating with the nozzle 41 and providing, at a front end of the second fluid feed chamber 56, a second through-hole 50 communicating with the nozzle 41, the first through-hole 49 having a smaller width than the second through-hole 50 and provided below a middle portion of the second through-hole 50.

An eighth aspect of the present invention resides in the two-fluid dispenser of the first aspect, wherein the cross-sectional pattern of the dispensed fluids comprises the first fluid layer L1 and the second fluid layer L2 surrounding the upper, a lower, a right, and a left surface of the first fluid layer L1.

A ninth aspect of the present invention resides in the two-fluid dispenser of the eighth aspect, wherein the dispenser head B3 further includes: a casing 40 having a front surface from which the nozzle 41 protrudes; and a first and a second stem fitting tube 42 and 43 suspending from the casing 40 such that the first stem fitting tube 42 is fitted to a first stem 11*a* and the second stem fitting tube 43 is fitted to a second stem 11*b*, and wherein the fluid guide mechanism is structured by providing a partition wall 45*c* in a middle portion of the casing 40 to divide a space in the casing 40 into a first and a second fluid compartment 46 and 47 on a right and a left side, the partition wall 45*c* including a front front-rear wall 60 extending rearward, a horizontal wall 61 extending leftward from a rear end of the front front-rear wall 60, and a rear front-rear wall 62 extending rearward from another end of the horizontal wall 61, by providing, at a middle portion of the horizontal wall 61, a dispenser hole 63 for dispensing the fluid from the first fluid compartment 46 into the second fluid compartment 47, and by providing, in front of the dispenser hole 63, a through-hole 64 communicating with the nozzle 41.

Advantageous Effects

According to the present invention, the dispenser head B3 is provided inside thereof with the fluid guide mechanism to guide the fluids from the dispenser containers to be dispensed in the form of either the foam or the viscous fluid through the nozzle 41 such that the cross-sectional pattern of the dispensed fluids has the layered structure in which at least the upper surface of a first fluid layer L1 is covered by the second fluid layer L2. Accordingly, even when the dispensed first fluid layer L1 has a pungent odor and the like, volatilization thereof is prevented by the second fluid layer L2. Consequently, the pungent odor is sufficiently reduced. In particular, consider that fluids that are dispensed directly onto an application surface, palms, a comb, a cup, or the like in usage are contained, such as a case of the hair dye. In this case, even when a lower surface of the first fluid layer L1 is exposed, the exposed surface is covered by the application surface, palms, comb, cup, or the like, and it is further ensured that the odor of the dispensed fluid is reduced.

Furthermore, by depressing the dispenser head B3, the two fluids are dispensed in the aforementioned manner. Accordingly, the dispensed fluids are extremely convenient to handle.

When the cross-sectional pattern of the dispensed fluids comprises the first fluid layer L1 and the second fluid layer L2 layered on the first fluid layer L1, and the second fluid layer L2 has the same width as the first fluid layer L1, although a right, a left, and the lower surface of the first fluid layer L1 are exposed immediately after the dispensing, the upper surface of the first fluid layer L1 is covered by the second fluid layer L2. Accordingly, the above structure provides the advantageous effect of sufficiently reducing the odor. In particular when the fluids are dispensed onto the application surface with the first fluid layer L1 below the second fluid layer L2, a more remarkable advantageous effect is achieved.

The third to fifth aspects provide, in addition to the above advantageous effect, a further advantageous effect that the fluid guide mechanism is formed by a highly simple structure.

Furthermore, when the cross-sectional pattern of the dispensed fluids comprises the first fluid layer L1 and the second fluid layer L2 covering the upper, the right, and the left surface of the first fluid layer L1, although the lower surface of the first fluid layer L1 is exposed immediately after the dispensing, the upper, the right, and the left surface of the first fluid layer L1 are covered by the second fluid layer L2. Accordingly, the above structure further provides the advantageous effect of reducing the odor. In particular when the fluids are dispensed onto the application surface with the first fluid layer L1 below the second fluid layer L2, a more remarkable advantageous effect is achieved.

The seventh aspect also provides, in addition to the above advantageous effect, the advantageous effect that the fluid guide mechanism is formed by the highly simple structure as in the aforementioned case. Furthermore, despite the simple structure, the seventh aspect provides yet a further advantageous effect that the fluids are dispensed such that the cross-sectional pattern of the dispensed fluids is clearly divided by the first fluid layer L1 and the second fluid layer L2 covering the upper, the right, and the left surface of the first fluid layer L1.

Furthermore, when the cross-sectional pattern of the dispensed fluids comprises the first fluid layer L1 and the second fluid layer L2 surrounding the upper, the lower, the right, and the left surface of the first fluid layer L1, the first fluid layer L1 in its entirety, except for a front surface thereof, is surrounded by the second fluid layer L2. Accordingly, an even more remarkable advantageous effect of reducing the odor is achieved.

Similarly to the above case, the ninth aspect provides the advantageous effect that the fluid guide mechanism is formed by the highly simple structure. Furthermore, despite the simple structure, the ninth aspect also provides yet a further advantageous effect that the fluids are dispensed such that the cross-sectional pattern of the dispensed fluids is clearly divided by the first fluid layer L1 and the second fluid layer L2 surrounding the upper, the lower, the right, and the left surface of the first fluid layer L1.

BRIEF DESCRIPTION OF DRAWINGS

The present invention will be further described below with reference to the accompanying drawings, wherein.

DESCRIPTION OF EMBODIMENTS

Figure 1:
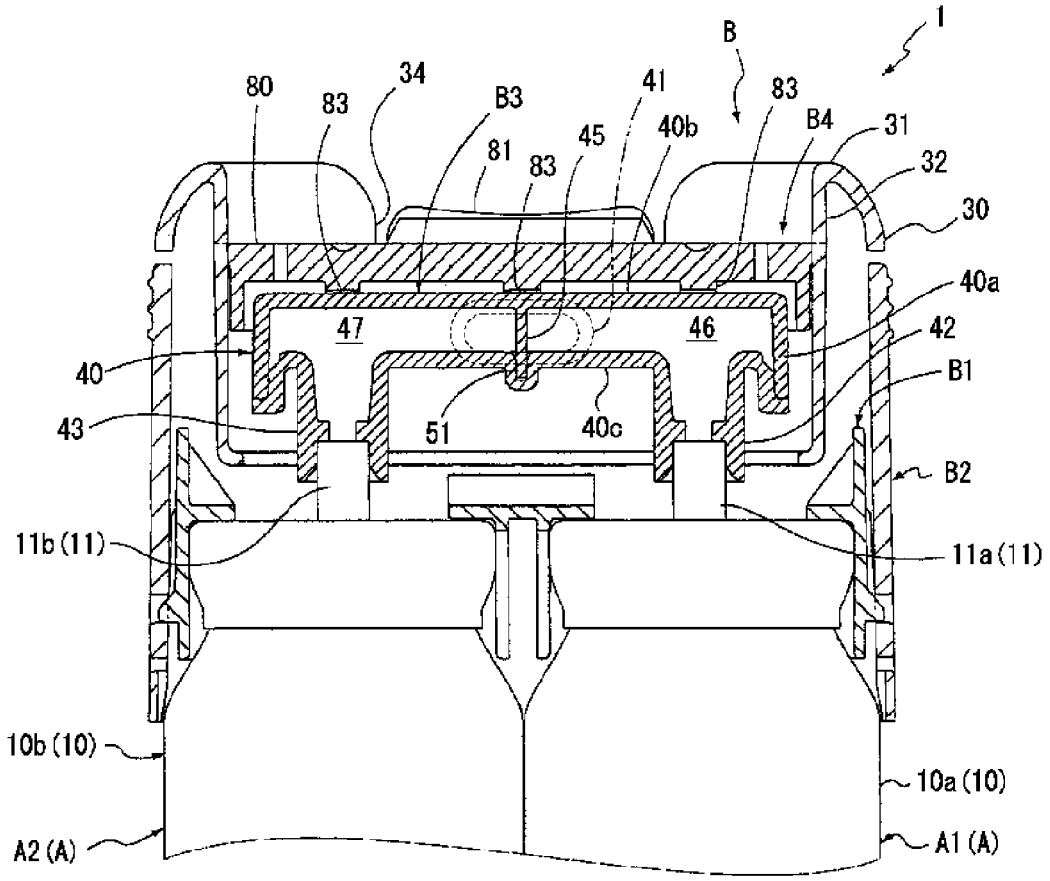
FIG. 1 is a sectional view of part of a two-fluid dispenser according to a first embodiment.
Figure 2:
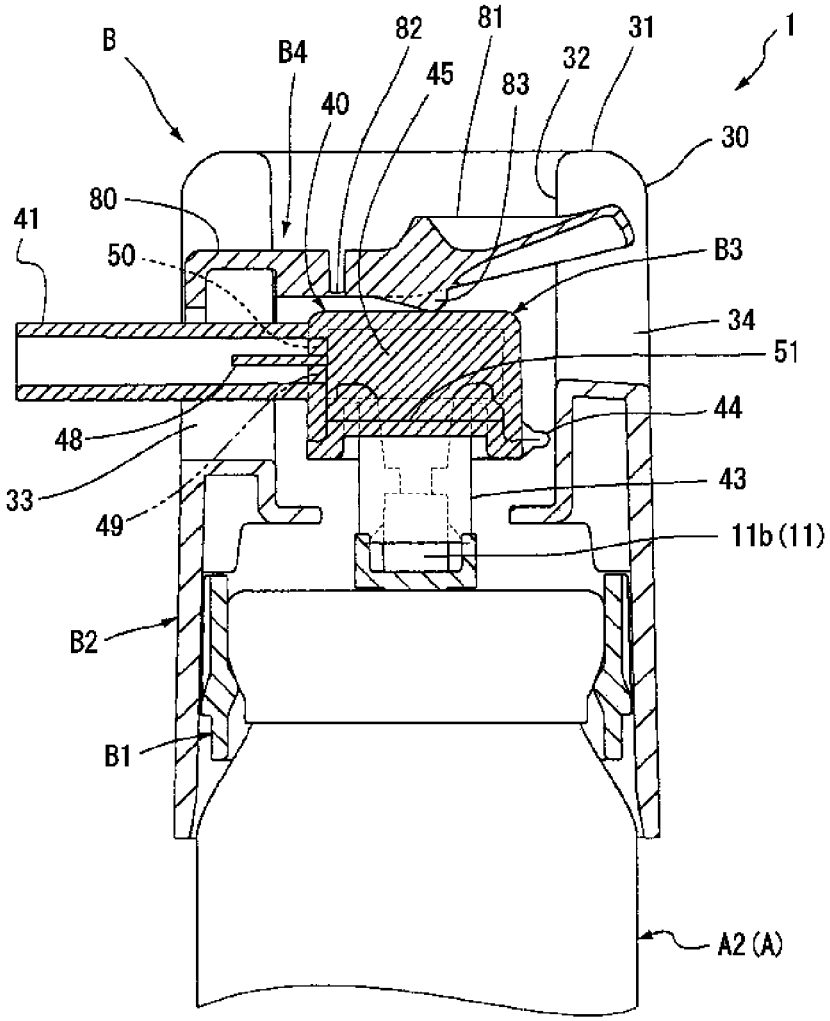
FIG. 2 is another sectional view of part of the two-fluid dispenser of the first embodiment.

Embodiments of the present invention are described below with reference to the drawings.

FIGS. 1-8 show a first embodiment of a two-fluid dispenser 1 including a pair of dispenser containers A and a dispenser tool B. Each dispenser container A includes a trunk 10, and the trunk 10 has an upper surface from which an upwardly urged and depressible stem 11 protrudes. In the present embodiment, the pair of a first and a second dispenser container A1 and A2 is a pair of aerosol cans.

The first and the second dispenser container A1 and A2 have a first trunk 10*a* and a second trunk 10*b* from which upwardly urged and depressible stems 11*a* and 11*b* protrude, respectively. Each dispenser container employs a known mechanism in which, when the stem is depressed, an internal dispenser valve is opened, and the fluid is dispensed through the stem by a gas pressure in the container, and when the stem is undepressed, the stem is upwardly displaced due to an upwardly urging force, and the internal dispenser valve is closed to prevent the fluid from being dispensed. However, the dispenser container is not limited to the aerosol can, and the dispenser container may be any container that includes a built-in pump mechanism having a cylinder and a piston as long as the container satisfies the requirements that, when the stem is depressed, the fluid is dispensed, and when the stem is undepressed, the stem is upwardly displaced due to the upwardly urging force to prevent the fluid from being dispensed.

Furthermore, the fluids dispensed from the dispenser containers are required to have shape retention to form the cross-sectional pattern which is later described. Accordingly, the fluids contained in the dispenser containers are those that are dispensed in the form of either a form or a viscous fluid. The above dispensed forms may be selected depending on a known foam structure in the dispenser containers and properties of the contained fluids.

The dispenser tool B includes a container fixing mount B1, a container fixing tube B2, a dispenser head B3, and a depression operation part B4.

The container fixing mount B1 serves to fix the first and the second dispenser container A1 and A2 by being fitted to upper circumferential surfaces of the first and the second dispenser container A1 and A2.

The container fixing tube B2 includes an outer circumferential wall 30, and a lower portion of the outer circumferential wall 30 is fitted to the circumferential surfaces of the juxtaposed first and second dispenser container A1 and A2 via the container fixing mount B1. The container fixing tube B2 also includes a flange top wall 31 extending inward from an upper end of the outer circumferential wall 30, and an inner circumferential wall 32 suspending from the flange top wall 31 to extend across the first and the second dispenser container A1 and A2 for tight binding. Furthermore, the container fixing tube B2 includes at a front and a rear thereof a front recess 33 and a rear recess 34, respectively. The front and the rear recess 33 and 34 are each formed by forming downward dents in the inner circumferential wall 32, the outer circumferential wall 30, and the flange top wall 31. The front and the rear recess 33 and 34 each also have openings on an upper, a front, and a rear surface thereof.

As shown in FIGS. 1-7, the dispenser head B3 includes a casing 40 having a horizontally-oriented ellipsoidal tube shape, a nozzle 41 protruding from a front surface of the casing 40, and a pair of a first and a second stem fitting tube 42 and 43 suspended from a right side and a left side of a lower surface of the casing 40. The dispenser head B3 is also provided inside thereof with a fluid guide mechanism.

Figure 3:
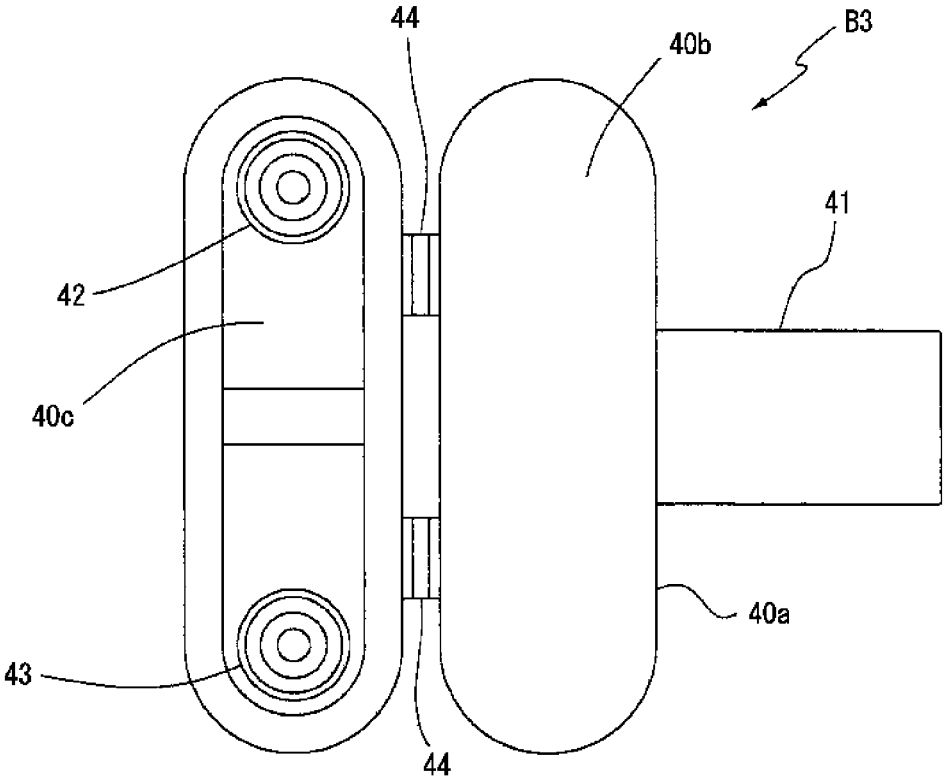
FIG. 3 is a plan view of an unassembled dispenser head of the first embodiment.
Figure 4:
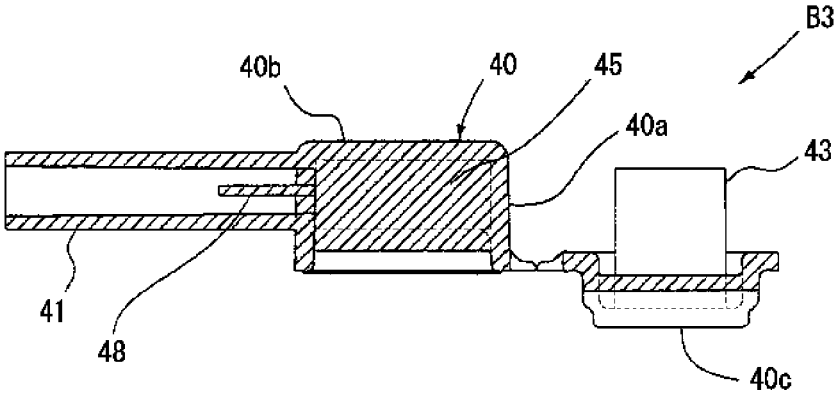
FIG. 4 is a vertical sectional view of the unassembled dispenser head of the first embodiment.
Figure 5:
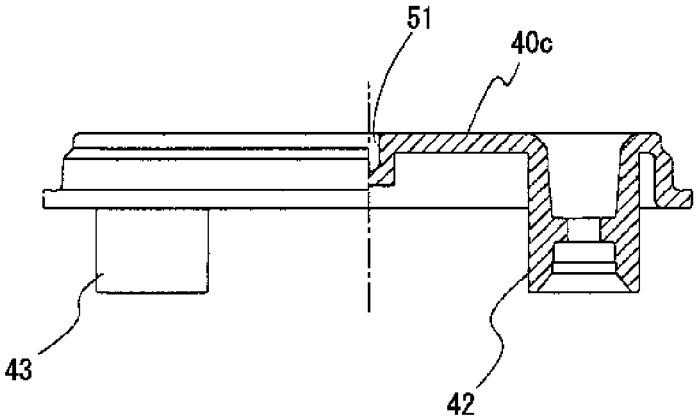
FIG. 5 is a half-sectional view of part of a bottom wall portion of the dispenser head of the first embodiment.
Figure 6:
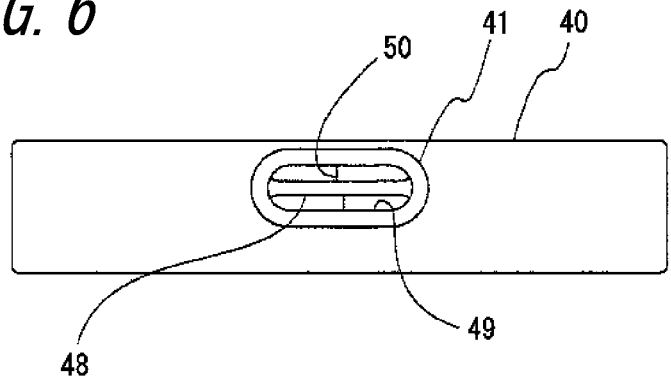
FIG. 6 is a front view of part of a casing of the dispenser head of the first embodiment.
Figure 7:
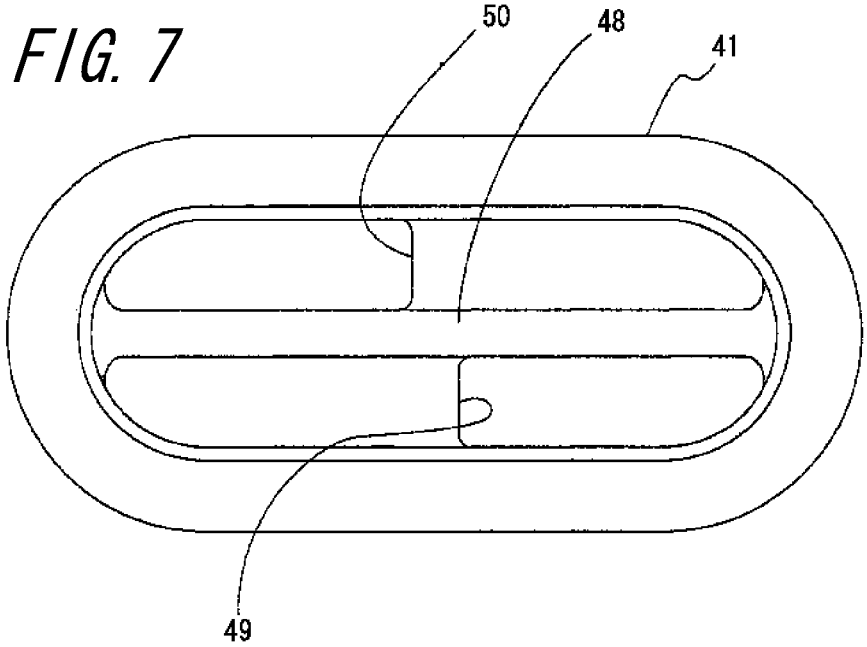
FIG. 7 is an enlarged front view of par of a nozzle portion of the dispenser head of the first embodiment.

As shown in FIGS. 3-5, the dispenser head B3 of the present embodiment is structured by forming a casing main body having a circumferential wall 40*a* and a top wall 40*b*, and forming an open bottom wall 40*c* extending from the casing main body via a pair of connection hinges 44, and by fixing the bottom wall 40*c* to the casing main body by ultrasonic bonding at a time of assembly.

Figure 8:
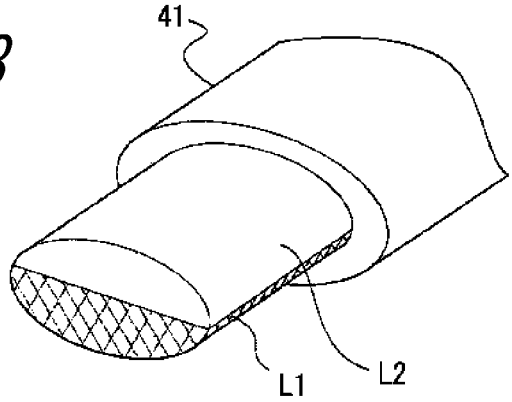
FIG. 8 is a perspective view of part of a fluid dispensing pattern of the first embodiment.

The fluid guide mechanism guides the viscous fluids from the dispenser containers to be dispensed through the nozzle 41 such that a cross-sectional pattern of the dispensed fluids has a layered structure in which at least an upper surface of a first fluid layer L1 is covered by a second fluid layer L2. As shown in FIG. 8, the present embodiment is provided with the mechanism by which the cross-sectional pattern of the dispensed fluids comprises the first fluid layer L1 and the second fluid layer L2 layered on the first fluid layer L1, and the second fluid layer L2 has a same width as the first fluid layer L1.

The fluid guide mechanism of the present embodiment is structured by providing a partition wall 45 in a middle portion of the casing 40 to divide a space in the casing 40 into a first and a second fluid compartment 46 and 47 on the right and the left side, and by providing an upper-lower partition wall 48 dividing a base end portion of the nozzle 41 into an upper base end portion and a lower base end portion to provide a first through-hole 49 for bringing the first fluid compartment 46 into communication with a lower portion of the nozzle 41 and a second through-hole 50 for bringing the second fluid compartment 47 into communication with an upper portion of the nozzle 41. Note that the partition wall 45 of the present embodiment is integrally formed with the casing main body and configured to be fitted at a lower end portion thereof to a fitting recess 51 provided in a predetermined position of the bottom wall 40*c*.

The depression operation part B4 includes a mounting frame 80 and a depression plate 81. The mounting frame 80 is fitted to an inner surface of the inner circumferential wall 32 of the container fixing tube B2. The depression plate 81 is connected at a front end portion thereof to a front end of the mounting frame 80 via a hinge 82. The depression plate 81 has at an upper rear surface thereof a depression part and has at a bottom surface thereof a depression protrusion 83 that protrudes to abut against an upper surface of the casing 40. Accordingly, the dispenser head B3 can be pushed down by depressing and pivoting the depression part about the hinge 82.

When the two-fluid dispenser 1 configured as above is used, the depression part is depressed to cause the depression plate 81 to pivot about the hinge 82, so that the dispenser head B3 is pushed down, and the first and the second stem 11*a* and 11*b* of the first and the second dispenser container A1 and A2 are depressed, respectively. Consequently, the first fluid dispensed from the first dispenser container A1 through the first stem 11*a* is dispensed in the form of the foam from the first fluid compartment 46 to the lower portion of the nozzle 41 below the upper-lower partition wall 48 through the first through-hole 49. On the other hand, the second fluid dispensed from the second dispenser container A2 through the second stem 11*b* is dispensed in the form of the foam from the second fluid compartment 47 to the upper portion of the nozzle 41 above the upper-lower partition wall 48 through the second through-hole 50. Thus, as shown in FIG. 8, the first and the second fluid are dispensed through an end of the nozzle 41 such that the cross-sectional pattern of the dispensed fluids comprises the first fluid layer L1 and the second fluid layer L2 layered on the first fluid layer L1, and the second fluid layer L2 has a same width as the first fluid layer L1.

In the above embodiment, when the first fluid layer L1 is a volatile fluid with a pungent odor, and the second fluid layer L2 is a non-volatile fluid without a pungent odor, the odor of the first fluid layer L1 is reduced by the second fluid layer L2. In particular when a hair dye is contained as the fluids, the hair dye is dispensed directly onto the application surface or temporarily on the palms and the like, and therefore, the exposed surface of the first fluid layer L1 is mostly covered, and the odor is further reduced.

Figure 9:
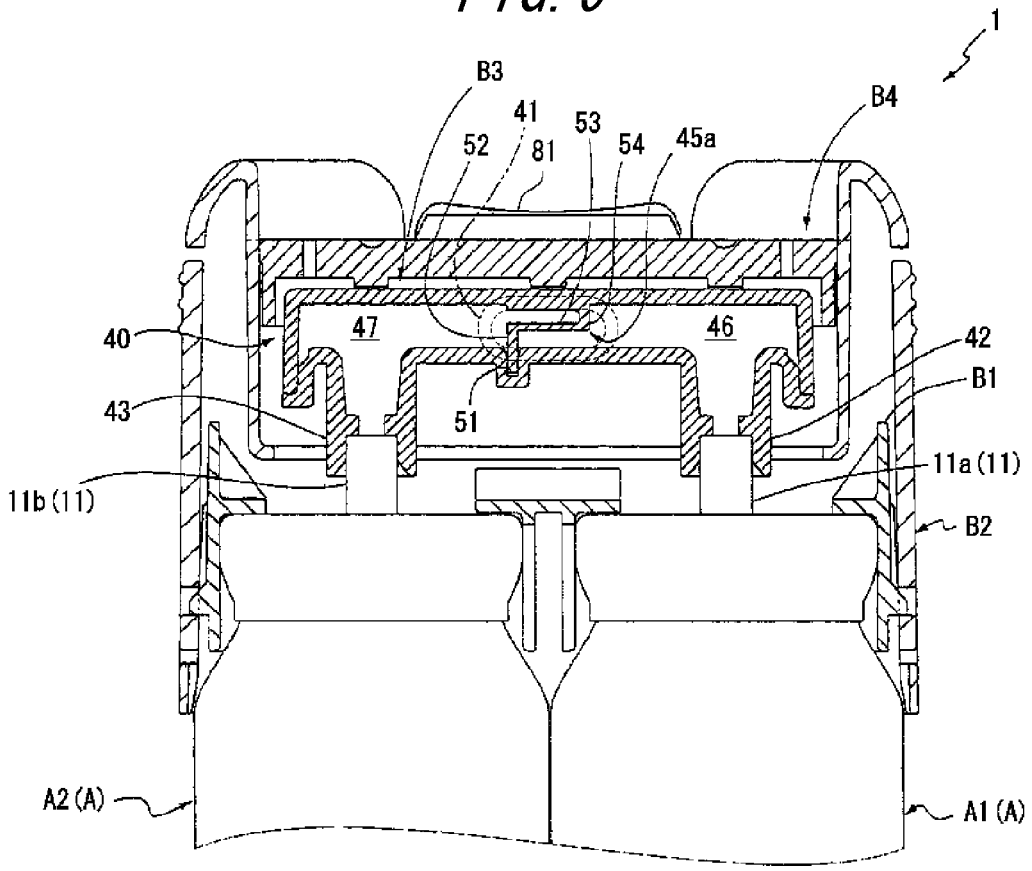
FIG. 9 is a sectional view of part of a two-fluid dispenser according to a second embodiment.
Figure 10:
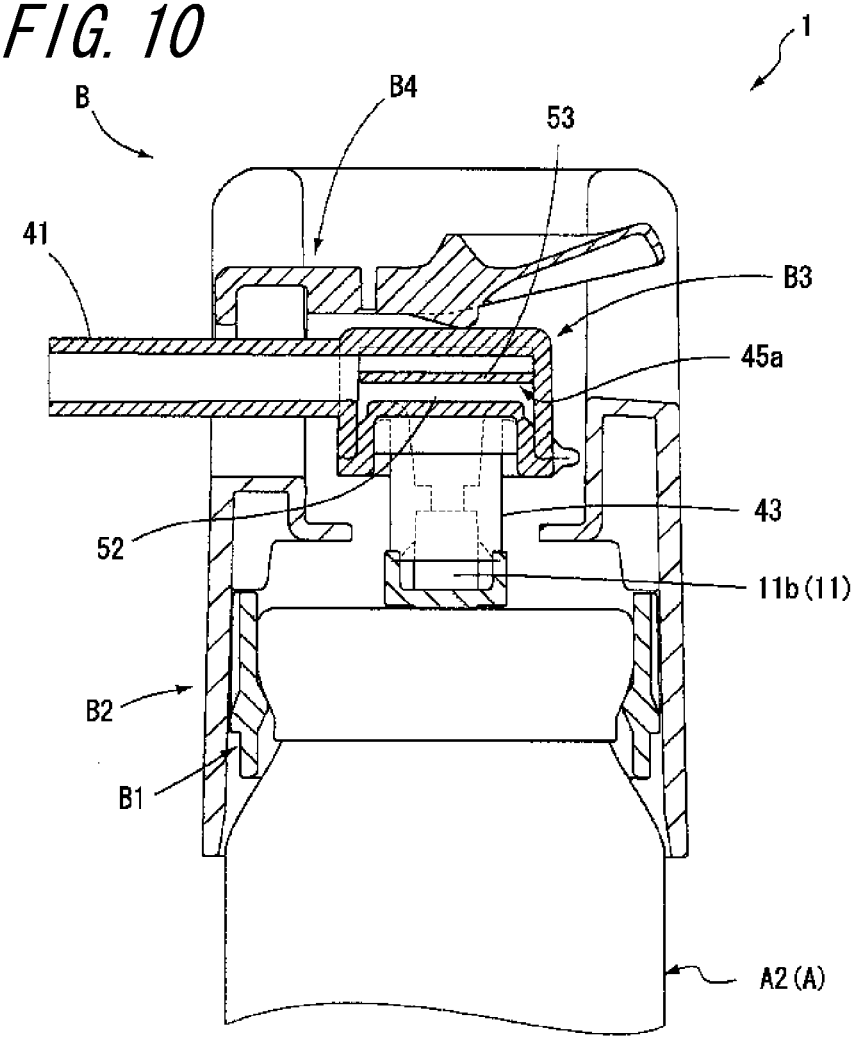
FIG. 10 is another sectional view of part of the two-fluid dispenser of the second embodiment.
Figure 11:
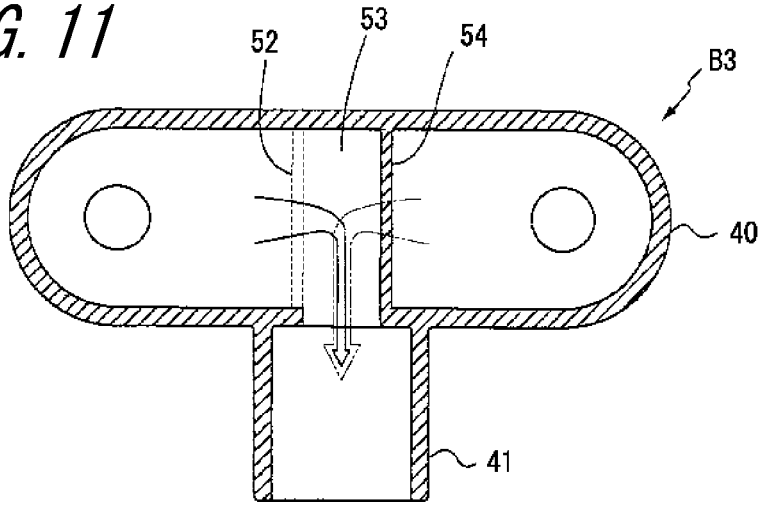
FIG. 11 shows a fluid flow in a dispenser head of the second embodiment.
Figure 12:
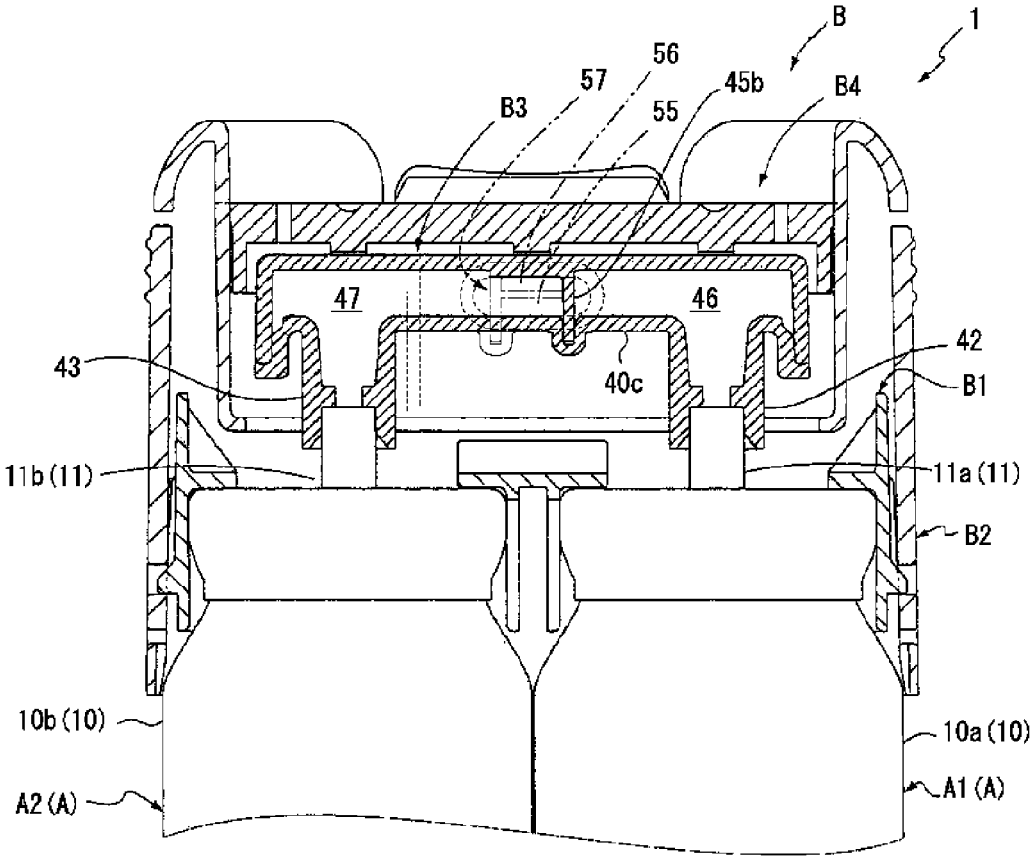
FIG. 12 is a sectional view of part of a two-fluid dispenser according to a third embodiment.
Figure 13:
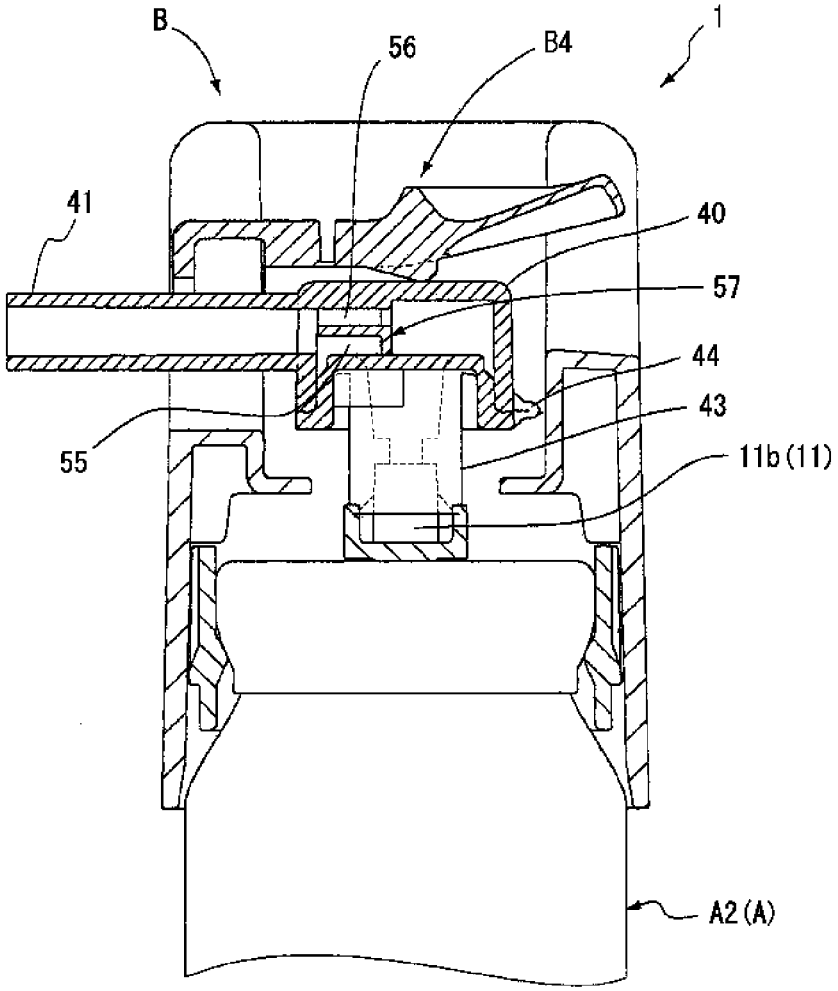
FIG. 13 is another sectional view of part of the two-fluid dispenser of the third embodiment.
Figure 14:
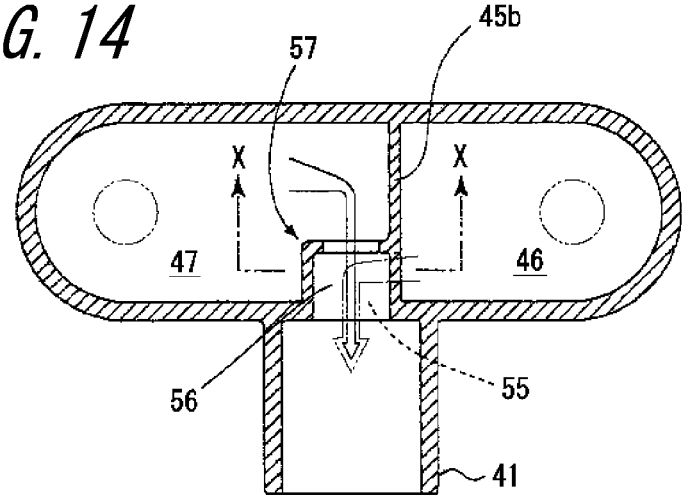
FIG. 14 shows a fluid flow in a dispenser head of the third embodiment.
Figure 15:
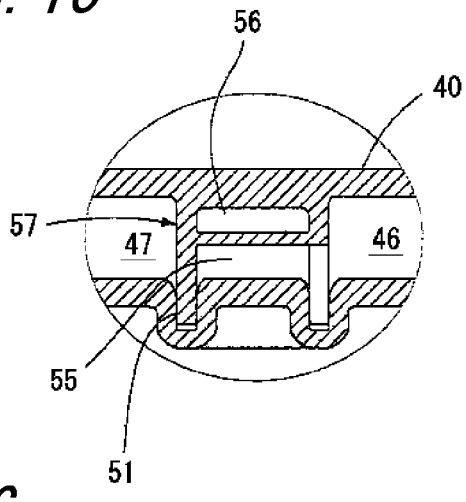
FIG. 15 is a vertical sectional view taken along a line X-X shown in FIG. 14 of the third embodiment.
Figure 16:
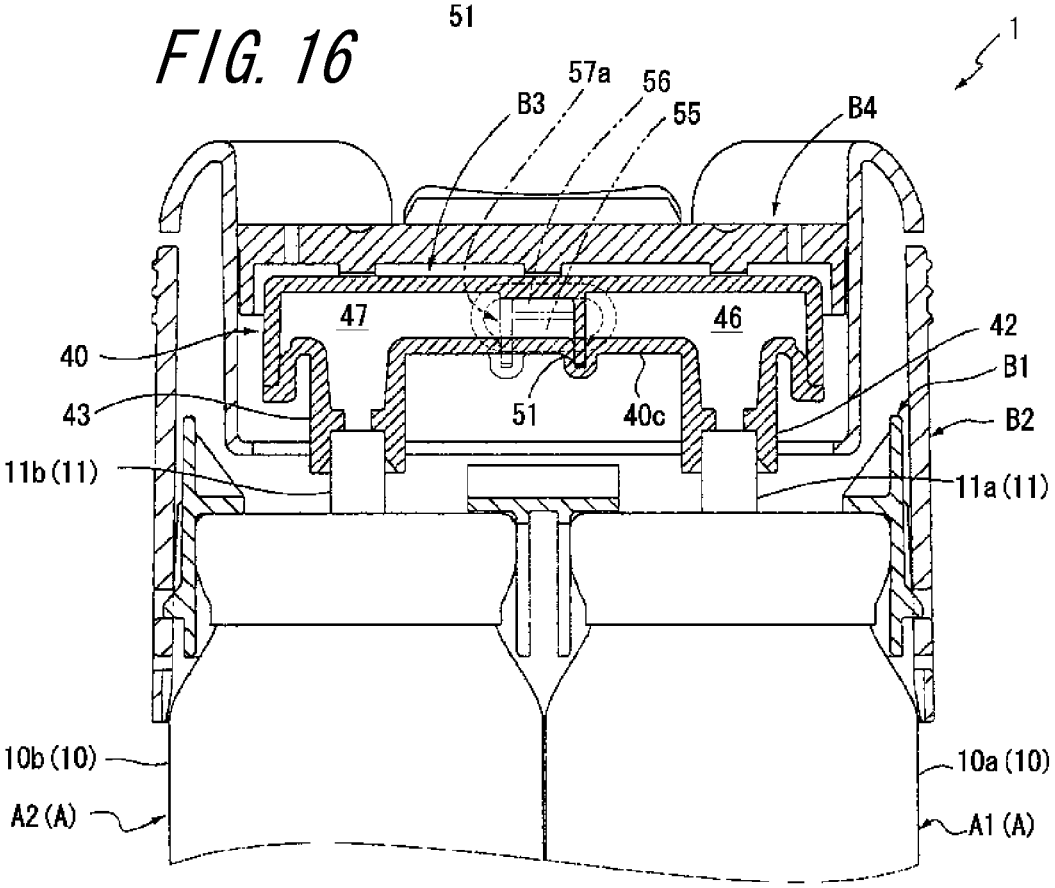
FIG. 16 is a sectional view of part of a two-fluid dispenser according to a fourth embodiment.
Figure 17:
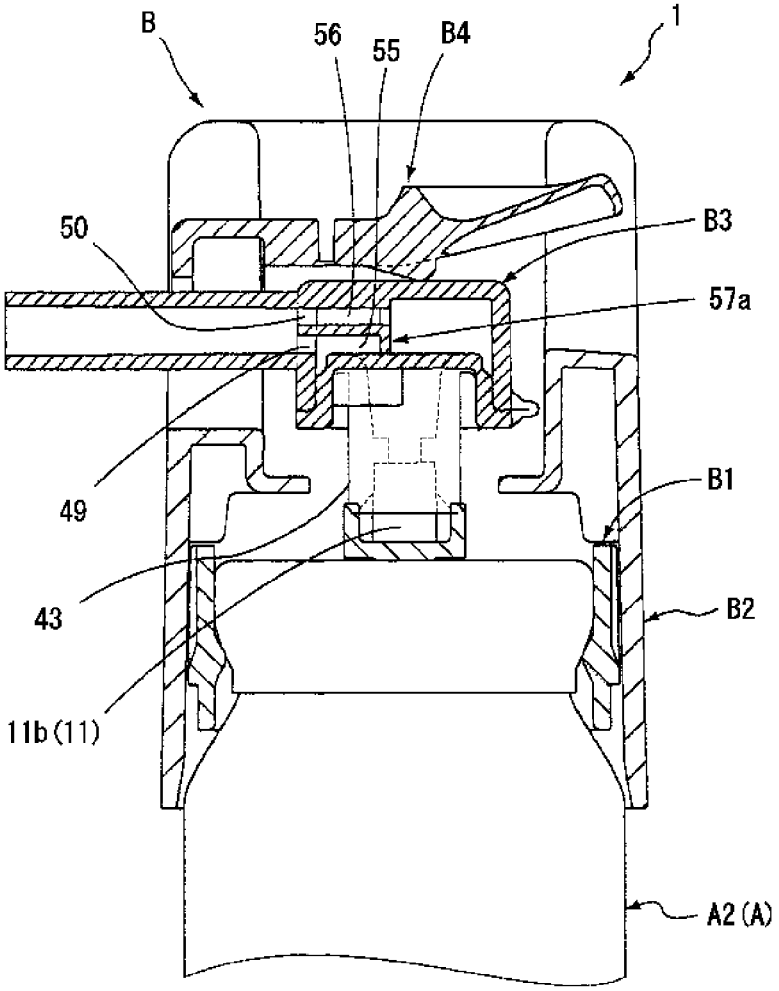
FIG. 17 is another sectional view of part of the two-fluid dispenser of the fourth embodiment.
Figure 18:
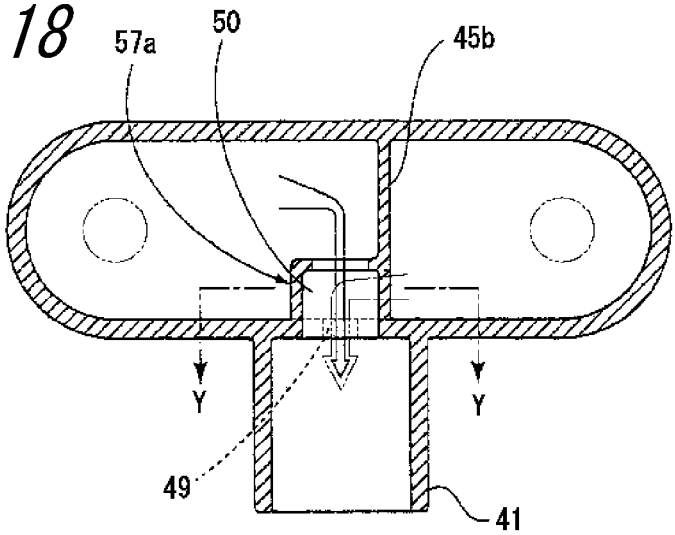
FIG. 18 shows a fluid flow in a dispenser head of the fourth embodiment.
Figure 19:
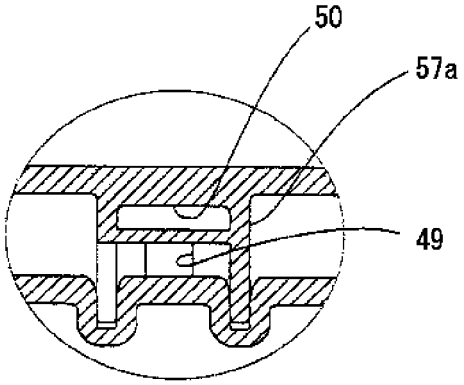
FIG. 19 is a vertical sectional view taken along a line Y-Y shown in FIG. 18 of the fourth embodiment.

FIGS. 9-11 show a second embodiment. The second embodiment includes basically the same structure as in the embodiment shown in FIG. 1, except for the dispenser head B3. Accordingly, with the exception of the dispenser head B3, the same reference numerals are assigned to the same or like components, and a description thereof is omitted. Furthermore, the dispenser head B3 also includes the same structure as in the embodiment shown in FIG. 1 in that the dispenser head B3 includes the casing 40, the pair of the first and the second stem fitting tube 42 and 43 suspended from the casing 40 such that the first stem fitting tube 42 is fitted to the first stem 11*a* of the first dispenser container A1, and the second stem fitting tube 43 is fitted to the second stem 11*b* of the second dispenser container A2, and the nozzle 41 protruding from the front surface of the casing 40. The dispenser head B3 of the present embodiment differs in the fluid guide mechanism provided therein. In this regard, the same also applies to other embodiments described below, and the above description is omitted hereinafter.

The fluid guide mechanism of the present embodiment includes a partition wall 45*a* that vertically extends in a front-to-rear direction in a middle portion of the casing 40. The partition wall 45*a* includes a cross-sectional structure having a lower vertical wall 52, a horizontal wall 53 extending from an upper end of the lower vertical wall 52, and an upper vertical wall 54 standing from another end of the horizontal wall 53, and the partition wall 45*a* divides a space in the casing 40 into the first and the second compartment 46 and 47 on the right and the left side. Furthermore, a front end of a space below the horizontal wall 53 communicates with a lower base end portion of the nozzle 41 through a through-hole at a base end opening position of the nozzle 41 provided on the casing circumferential wall 40*a*, and a front end of a space above the horizontal wall 53 similarly communicates with an upper base end portion of the nozzle 41.

In the above embodiment, the first fluid dispensed from the first dispenser container A1 is dispensed in the form of the foam from the first fluid compartment 46 to the lower base end portion of the nozzle 41 through the space below the horizontal wall 53. On the other hand, the second fluid dispensed from the second dispenser container A2 is dispensed in the form of the foam from the second fluid compartment 47 to the upper base end portion of the nozzle 41 through the space above the horizontal wall 53. Thus, similarly to the embodiment shown in FIG. 1, the first and the second fluid are dispensed through the end of the nozzle 41 such that the cross-sectional pattern of the dispensed fluids comprises the first fluid layer L1 and the second fluid layer L2 layered on the first fluid layer L1, and the second fluid layer L2 has a same width as the first fluid layer L1.

FIGS. 12-15 show a third embodiment. In the fluid guide mechanism of the present embodiment, a first fluid feed chamber 55 on a lower side and a second fluid feed chamber 56 on an upper side are defined by a partition wall 57 and the casing bottom wall 40*c* in a front end of the casing 40 located at a rear of the nozzle 41. The first and the second fluid feed chamber 55 and 56 each have a flat cuboid shape. Furthermore, a partition wall 45*b* extending from a rear right end of the partition wall 57 to the casing circumferential wall 40*a* is provided to divide a space in the casing 40 except for the first and the second fluid feed chamber 55 and 56 into the first fluid compartment 46 on the right side and the second fluid compartment 47 on the left side.

The first fluid feed chamber 55 is provided with an aperture on the right side thereof, and the second fluid feed chamber 56 is provided with a communication hole at a rear end thereof. Through the aperture, the first fluid compartment 46 communicates with the first fluid feed chamber 55, and through the communication hole, the second fluid compartment 47 communicates with the second fluid feed chamber 56. Moreover, the first fluid feed chamber 55 communicates at a front end thereof with a lower base end portion of the nozzle 41 and the second fluid feed chamber 56 communicates at a front end thereof with a upper base end portion of the nozzle 41, through through-holes at the base end opening position of the nozzle 41 provided on the casing circumferential wall 40*a*.

In the above embodiment, the first fluid dispensed from the first dispenser container A1 is dispensed in the form of the foam from the first fluid compartment 46 to the lower base end portion of the nozzle 41 through the first fluid feed chamber 55. On the other hand, the second fluid dispensed from the second dispenser container A2 is dispensed in the form of the foam from the second fluid compartment 47 to the upper base end portion of the nozzle 41 through the second fluid feed chamber 56. Thus, similarly to the embodiment shown in FIG. 1, the first and the second fluid are dispensed through the end of the nozzle 41 such that the cross-sectional pattern of the dispensed fluids comprises the first fluid layer L1 and the second fluid layer L2 layered on the first fluid layer L1, and the second fluid layer L2 has a same width as the first fluid layer L1.

FIGS. 16-20 show a fourth embodiment. In the fluid guide mechanism of the present embodiment, the lower first fluid feed chamber 55 and the upper second fluid feed chamber 56 are defined by a partition wall 57*a* and the casing bottom wall 40*c* in the front end of the casing 40 located at the rear of the nozzle 41. The first and the second fluid feed chamber 55 and 56 each have a flat cuboid shape. Furthermore, the partition wall 45*b* extending from the rear right end of the partition wall 57*a* to the casing circumferential wall 40*a* is provided to divide a space in the casing 40 except for the first and the second fluid feed chamber 55 and 56 into the first fluid compartment 46 on the right side and the second fluid compartment 47 on the left side. Moreover, the first fluid feed chamber 55 is provided with an aperture on the right side thereof, and the second fluid feed chamber 56 is provided with a communication hole at the rear end thereof. Through the aperture, the first fluid compartment 46 communicates with the first fluid feed chamber 55, and through the communication hole, the second fluid compartment 47 communicates with the second fluid feed chamber 56. Moreover, the first through-hole 49 communicating with the nozzle 41 is provided at the front end of the first fluid feed chamber 55 on the casing circumferential wall 40*a*, and the second through-hole 50 communicating with the nozzle 41 is provided at the front end of the second fluid feed chamber 56 on the casing circumferential wall 40*a*. The first through-hole 49 has a smaller width than the second through-hole 50 and provided below a middle portion of the second through-hole 50.

Figure 20:
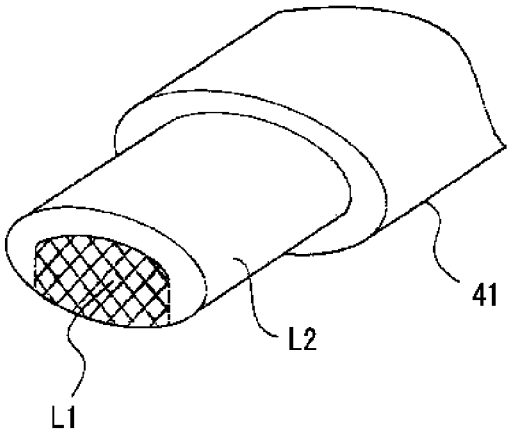
FIG. 20 is a perspective view of part of a fluid dispensing pattern of the fourth embodiment.
Figure 21:
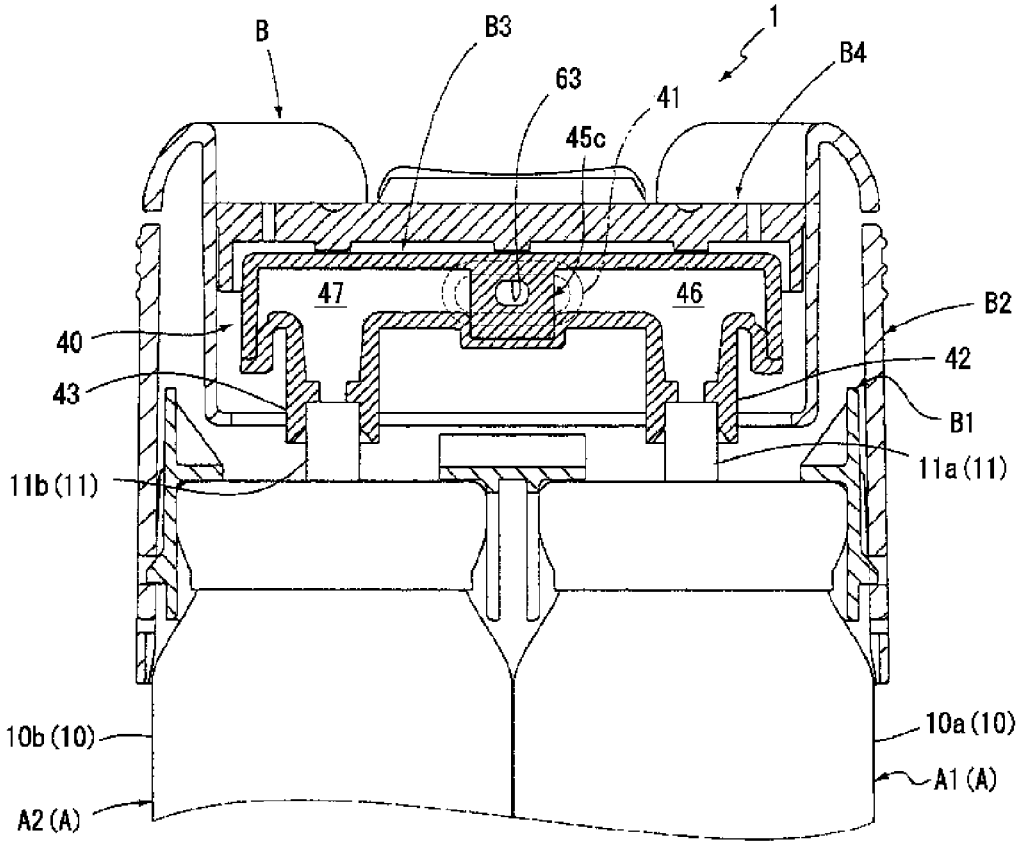
FIG. 21 is a sectional view of part of a two-fluid dispenser according to a fifth embodiment.
Figure 22:
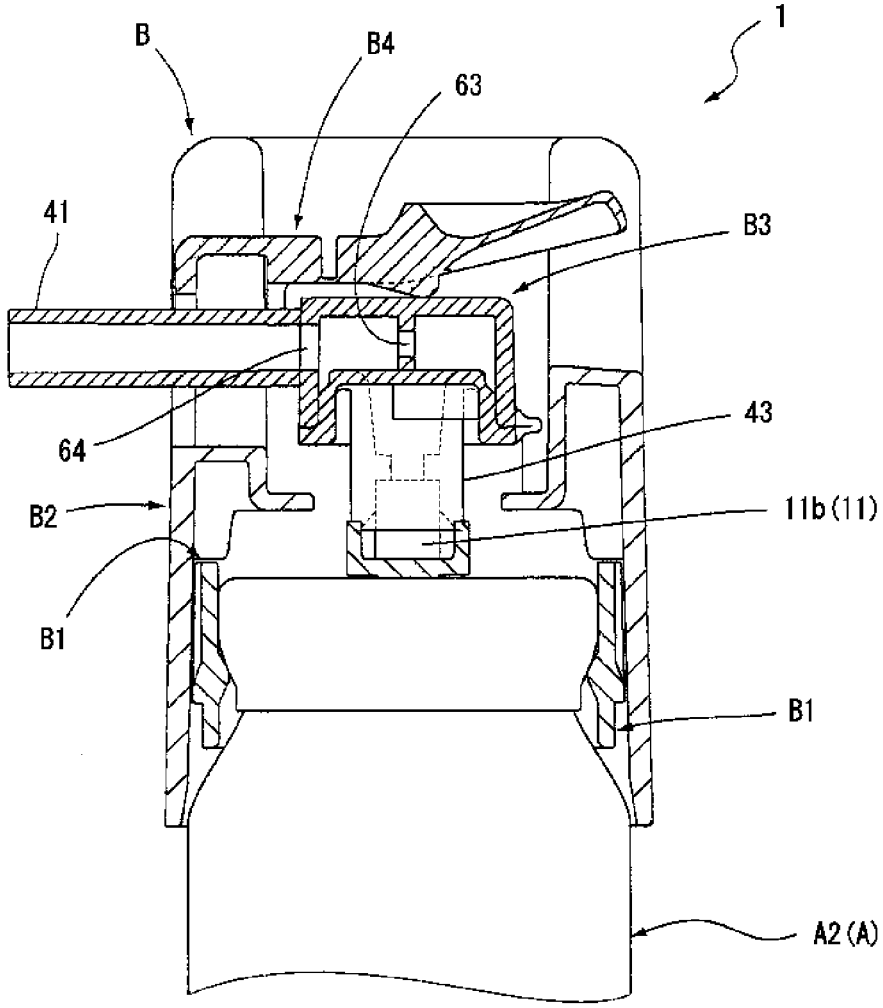
FIG. 22 is another sectional view of part of the two-fluid dispenser of the fifth embodiment.
Figure 23:
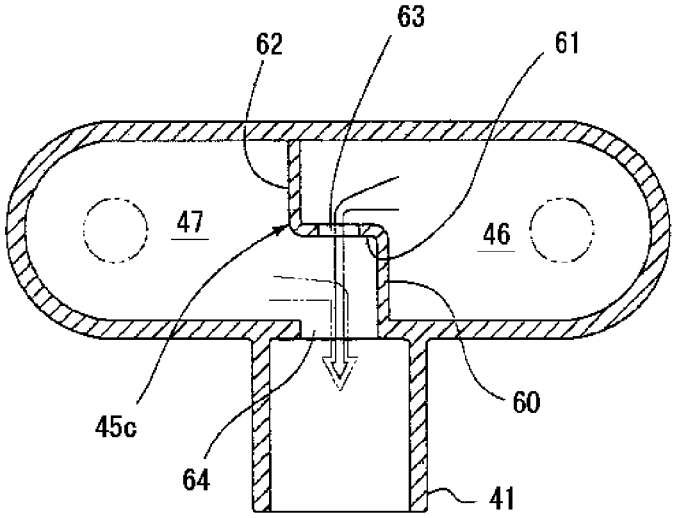
FIG. 23 shows a fluid flow in a dispenser head of the fifth embodiment.

The first fluid dispensed from the first dispenser container A1 is dispensed in the form of the foam from the first fluid compartment 46 to a lower middle base end portion of the nozzle 41 through the first fluid feed chamber 55 and the first through-hole 49. On the other hand, the second fluid dispensed from the second dispenser container A2 is dispensed in the form of the foam from the second fluid compartment 47 to an upper base end portion of the nozzle 41 through the second fluid feed chamber 56 and the second through-hole 50. In this regard, the first fluid is dispensed to the lower middle base end portion and the second fluid is dispensed to the upper base end portion such that a width of the first fluid is smaller than that of the second fluid, and therefore, both side portions of the second fluid intrude into the right and the left side of the first fluid when the fluids are dispensed into the nozzle 41. As a result, as shown in FIG. 20, when dispensed through the nozzle 41, the first and the second fluid have the cross-sectional pattern comprising the first fluid layer L1 and the second fluid layer L2 covering the upper, a right, and a left surface of the first fluid layer L1.

In the above embodiment, when the first fluid layer L1 is a volatile fluid with a pungent odor, and the second fluid layer L2 is a non-volatile fluid without a pungent odor, the odor of the first fluid layer L1 is further reduced by the second fluid layer L2.

FIGS. 21-24 show a fifth embodiment. In the fluid guide mechanism of the present embodiment, a partition wall 45*c* is provided in the middle portion of the casing 40 to divide a space in the casing 40 into the first fluid compartment 46 on the right side and the second fluid compartment 47 on the left side. The partition wall 45*c* includes a front front-rear wall 60 extending rearward, a horizontal wall 61 extending leftward from a rear end of the front front-rear wall 60, and a rear front-rear wall 62 extending rearward from another end of the horizontal wall 61.

Furthermore, a dispenser hole 63 for dispensing a fluid from the first fluid compartment 46 into the second fluid compartment 47 is provided at a middle portion of the horizontal wall 61, and in front of the dispenser hole 63, a through-hole 64 communicating with the nozzle 41 is provided.

Figure 24:
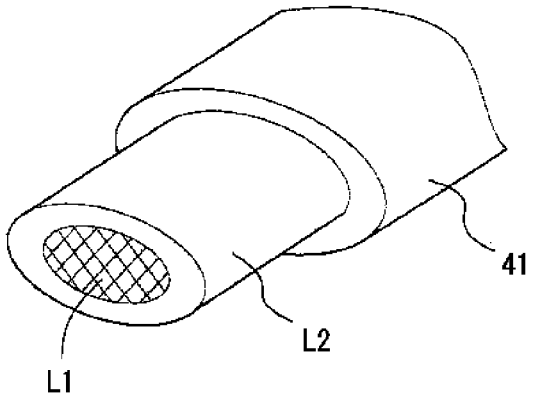
FIG. 24 is a perspective view of part of a fluid dispensing pattern of the fifth embodiment.

The first fluid dispensed from the first dispenser container A1 is further dispensed in the form of the foam from the first fluid compartment 46 into the nozzle 41 through the dispenser hole 63 and the through-hole 64. On the other hand, the second fluid dispensed from the second dispenser container A2 surrounds the first fluid in front of the horizontal wall 61, and further passes to the through-hole 64 to be dispensed into the nozzle 41 in the form of the foam while still surrounding the first fluid. As a result, as shown in FIG. 24, when dispensed through the nozzle 41, the first and the second fluid have the cross-sectional pattern comprising the first fluid layer L1 and the second fluid layer L2 surrounding the upper, a lower, the right, and the left surface of the first fluid layer L1.

In the above embodiment, when the first fluid layer L1 is a volatile fluid with a pungent odor, and the second fluid layer L2 is a non-volatile fluid without a pungent odor, it is further ensured that the odor of the first fluid layer L1 is reduced by the second fluid layer L2.

REFERENCE SIGNS

A dispenser container
A1 first dispenser container
A2 second dispenser container
B dispenser tool
B1 container fixing mount
B2 container fixing tube
B3 dispenser head
B4 depression operation part
L1 first fluid layer
L2 second fluid layer
1 two-fluid dispenser
10 trunk
11 stem

10*a* first trunk
10*b* second trunk
11*a* first stem
11*b* second stem
30 outer circumferential wall
31 flange top wall
32 inner circumferential wall
33 front recess
34 rear recess
40 casing
40*a* circumferential wall
40*b* top wall
40*c* bottom wall
41 nozzle
42 first stem fitting tube
43 second stem fitting tube
44 connection hinge
45, 45*a*, 45*b*, 45*c* partition wall
46 first fluid compartment
47 second fluid compartment
48 upper-lower partition wall
49 first through-hole
50 second through-hole
51 fitting recess
52 lower vertical wall
53 horizontal wall
54 upper vertical wall
55 first fluid feed chamber
56 second fluid feed chamber
57, 57*a* partition wall
60 front front-rear wall
61 horizontal wall
62 rear front-rear wall
63 dispenser hole
64 through-hole
80 mounting frame
81 depression plate
82 hinge
83 depression protrusion

The invention claimed is:

1. A two-fluid dispenser comprising:

a first dispenser container and a second dispenser container each including an upper surface from which an upwardly urged and depressible stem protrudes and is configured to dispense a fluid therein in a form of one of a foam and a viscous fluid in response to the stem being depressed; and a dispenser tool fixedly fitted over the first and second dispenser containers and arranged to dispense the two fluids from the first and second dispenser containers, the dispenser tool including a dispenser head communicating with the first and second dispenser containers and including a nozzle, so that when the dispenser head is depressed, the fluids are dispensed from the first and second dispenser containers through the nozzle, the dispenser head being provided with a fluid guide mechanism arranged to guide the fluids from the first and second dispenser containers through the nozzle such that, at least in a base end portion of the nozzle, a cross-sectional pattern of the dispensed fluids has a layered structure in which at least an upper surface of a first fluid layer is covered by a second fluid layer, the cross-sectional pattern of the dispensed fluids comprising the first fluid layer and the second fluid layer layered on the first fluid layer, the second fluid layer having a same width as the first fluid layer, the dispenser head further including a casing having a front surface from which the nozzle protrudes, the dispenser further including a first stem fitting tube and a second stem fitting tube suspending from the casing such that the first stem fitting tube is fitted to a first stem and the second stem fitting tube is fitted to a second stem, wherein the fluid guide mechanism has a first partition wall dividing a space inside the casing into a first fluid compartment on a right side of the space and a second fluid compartment on a left side of the space relative to a right-left direction of the front surface, and the fluid guide mechanism further has a second partition wall dividing a base end portion of the nozzle into an upper nozzle portion and a lower nozzle portion to provide a first through-hole via which the first fluid compartment communicates with the lower nozzle portion and a second through-hole via which the second fluid compartment communicates with the upper nozzle portion, the first through-hole being disposed to the right of the first partition wall and beneath the second partition wall, and the second through-hole being disposed to the left of the first partition wall and above the second partition wall.

2. The two-fluid dispenser of claim 1, wherein the second partition wall extends from the first through-hole and the second through-hole toward a free end of the nozzle so as to separate the first fluid layer from the second fluid layer.

3. A two-fluid dispenser comprising:

a first dispenser container and a second dispenser container each including an upper surface from which an upwardly urged and depressible stem protrudes and is configured to dispense a fluid therein in a form of one of a foam and a viscous fluid in response to the stem being depressed; and a dispenser tool fixedly fitted over the first and second dispenser containers and arranged to dispense the two fluids from the first and second dispenser containers, the dispenser tool including a dispenser head communicating with the first and second dispenser containers and including a nozzle, so that when the dispenser head is depressed, the fluids are dispensed from the first and second dispenser containers through the nozzle, the dispenser head being provided with a fluid guide mechanism arranged to guide the fluids from the first and second dispenser containers through the nozzle such that, at least in a base end portion of the nozzle, a cross-sectional pattern of the dispensed fluids has a layered structure in which at least an upper surface of a first fluid layer is covered by a second fluid layer, the cross-sectional pattern of the dispensed fluids comprising the first fluid layer and the second fluid layer layered on the first fluid layer, the second fluid layer having a same width as the first fluid layer, the dispenser head further including a casing having a front surface from which the nozzle protrudes, the dispenser further including a first stem fitting tube and a second stem fitting tube suspending from the casing such that the first stem fitting tube is fitted to a first stem and the second stem fitting tube is fitted to a second stem, wherein the fluid guide mechanism has a partition wall vertically extending in a front-to-rear direction in a middle portion of the casing to divide a space in the casing into a first fluid compartment on a right side of the space and a second fluid compartment on a left side of the space relative to a right-left direction of the front surface, the partition wall including a lower vertical wall, a horizontal wall extending from an upper end of the lower vertical wall, and an upper vertical wall extending from an end of the horizontal wall opposite from an end of the horizontal wall connected to the lower vertical wall such that a front end of a space below the horizontal wall communicates with a lower nozzle portion and a front end of a space above the horizontal wall communicates with an upper nozzle portion.

4. A two-fluid dispenser comprising:

a first dispenser container and a second dispenser container each including an upper surface from which an upwardly urged and depressible stem protrudes and is configured to dispense a fluid therein in a form of one of a foam and a viscous fluid in response to the stem being depressed; and a dispenser tool fixedly fitted over the first and second dispenser containers and arranged to dispense the two fluids from the first and second dispenser containers, the dispenser tool including a dispenser head communicating with the first and second dispenser containers and including a nozzle, so that when the dispenser head is depressed, the fluids are dispensed from the first and second dispenser containers through the nozzle, the dispenser head being provided with a fluid guide mechanism arranged to guide the fluids from the first and second dispenser containers through the nozzle such that, at least in a base end portion of the nozzle, a cross-sectional pattern of the dispensed fluids has a layered structure in which at least an upper surface of a first fluid layer is covered by a second fluid layer, the cross-sectional pattern of the dispensed fluids comprising the first fluid layer and the second fluid layer layered on the first fluid layer, the second fluid layer having a same width as the first fluid layer, the dispenser head further including a casing having a front surface from which the nozzle protrudes, the dispenser further including a first stem fitting tube and a second stem fitting tube suspending from the casing such that the first stem fitting tube is fitted to a first stem and the second stem fitting tube is fitted to a second stem, wherein the fluid guide mechanism has a first partition wall dividing a space in the casing into a first fluid compartment on a right side of the space and a second fluid compartment on a left side of the space relative to a right-left direction of the front surface, and the fluid guide mechanism has a second partition wall forming a lower fluid feed chamber and an upper fluid feed chamber in a front end of the casing located at a rear of the nozzle such that the first fluid compartment communicates with the lower fluid feed chamber through a first opening and the second fluid compartment communicates with the upper fluid feed chamber through a second opening, with the lower fluid feed chamber being open at a front end thereof to a lower nozzle portion and the upper fluid feed chamber being open at a front end thereof to an upper nozzle portion, the first opening being located beneath the second opening, and the first opening being located closer than the second opening to the front surface of the casing from which the nozzle protrudes.

5. A two-fluid dispenser comprising:

a first dispenser container and a second dispenser container each including an upper surface from which an upwardly urged and depressible stem protrudes and is configured to dispense a fluid therein in a form of one of a foam and a viscous fluid in response to the stem being depressed; and a dispenser tool fixedly fitted over the first and second dispenser containers and arranged to dispense the two fluids from the first and second dispenser containers, the dispenser tool including a dispenser head communicating with the first and second dispenser containers and including a nozzle, so that when the dispenser head is depressed, the fluids are dispensed from the first and second dispenser containers through the nozzle, the dispenser head being provided with a fluid guide mechanism arranged to guide the fluids from the first and second dispenser containers through the nozzle such that, at least in a base end portion of the nozzle, a cross-sectional pattern of the dispensed fluids has a layered structure in which at least an upper surface of a first fluid layer is covered by a second fluid layer, the cross-sectional pattern of the dispensed fluids comprising the first fluid layer and the second fluid layer covering the upper, a right, and a left surface of the first fluid layer, the dispenser head further including a casing having a front surface from which the nozzle protrudes, the dispenser further including a first stem fitting tube and a second stem fitting tube suspending from the casing such that the first stem fitting tube is fitted to a first stem and the second stem fitting tube is fitted to a second stem, wherein the fluid guide mechanism has a first partition wall dividing a space in the casing into a first fluid compartment on a right side of the space and a second fluid compartment on a left side of the space relative to a right-left direction of the front surface, and the fluid guide mechanism has a second partition wall forming a lower fluid feed chamber and an upper fluid feed chamber in a front end of the casing located at a rear of the nozzle such that the first fluid compartment communicates with the lower fluid feed chamber and the second fluid compartment communicates with the upper fluid feed chamber, the lower fluid feed chamber communicating with the nozzle via a first through-hole, and the upper fluid feed chamber communicating with the nozzle via a second through-hole, the first through-hole having a smaller width than the second through-hole, and the first through-hole being provided beneath a middle portion of the second through-hole.

6. A two-fluid dispenser comprising:

a first dispenser container and a second dispenser container each including an upper surface from which an upwardly urged and depressible stem protrudes and is configured to dispense a fluid therein in a form of one of a foam and a viscous fluid in response to the stem being depressed; and a dispenser tool fixedly fitted over the first and second dispenser containers and arranged to dispense the two fluids from the first and second dispenser containers, the dispenser tool including a dispenser head communicating with the first and second dispenser containers and including a nozzle, so that when the dispenser head is depressed, the fluids are dispensed from the first and second dispenser containers through the nozzle, the dispenser head being provided with a fluid guide mechanism arranged to guide the fluids from the first and second dispenser containers through the nozzle such that, at least in a base end portion of the nozzle, a cross-sectional pattern of the dispensed fluids has a layered structure in which at least an upper surface of a first fluid layer is covered by a second fluid layer, the cross-sectional pattern of the dispensed fluids comprises the first fluid layer and the second fluid layer surrounding the upper, a lower, a right, and a left surface of the first fluid layer, the dispenser head further including a casing having a front surface from which the nozzle protrudes, the dispenser further including a first stem fitting tube and a second stem fitting tube suspending from the casing such that the first stem fitting tube is fitted to a first stem and the second stem fitting tube is fitted to a second stem, wherein the fluid guide mechanism has a partition wall disposed in a middle portion of the casing dividing a space in the casing into a first fluid compartment on a right side of the space and a second fluid compartment on a left side of the space relative to a right-left direction of the front surface, the partition wall including a first front-rear wall extending away from the front surface of the casing in a direction orthogonal to the right-left direction, a horizontal wall extending leftward from a rear end of the first front-rear wall, and a second front-rear wall extending in the direction orthogonal to the right-left direction and extending away from an end of the horizontal wall which is opposite an end of the horizontal wall connected to the first front-rear wall, the horizontal wall having a dispenser hole at a middle portion thereof arranged to dispense the fluid from the first fluid compartment into the second fluid compartment, and the front surface of the casing having a through-hole communicating with the nozzle, the through-hole being disposed frontward of the dispenser hole.

* * * * *